US012168925B2

(12) United States Patent
Avdeev

(10) Patent No.: US 12,168,925 B2
(45) Date of Patent: Dec. 17, 2024

(54) GRAVITY TOOLFACE FOR WELLBORES

(71) Applicant: Nabors Drilling Technologies USA, Inc., Houston, TX (US)

(72) Inventor: Dmitry Avdeev, Exton, PA (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 1 day.

(21) Appl. No.: 17/934,594

(22) Filed: Sep. 23, 2022

(65) Prior Publication Data

US 2023/0102017 A1 Mar. 30, 2023

Related U.S. Application Data

(60) Provisional application No. 63/261,932, filed on Sep. 30, 2021.

(51) Int. Cl.
*E21B 47/0228* (2012.01)
*E21B 7/04* (2006.01)
*E21B 44/00* (2006.01)

(52) U.S. Cl.
CPC ..... *E21B 47/0228* (2020.05); *E21B 7/04* (2013.01); *E21B 44/00* (2013.01)

(58) Field of Classification Search
CPC ..... E21B 47/0228; E21B 7/04; E21B 44/00; E21B 47/017; E21B 47/022; E21B 47/024; E21B 47/02
See application file for complete search history.

(56) References Cited

U.S. PATENT DOCUMENTS 6,714,870 B1 3/2004 Weston et al.
7,801,704 B2 9/2010 Sato et al.
2003/0218547 A1* 11/2003 Smits ..... E21B 47/26 340/854.8
2007/0107937 A1 5/2007 Sugiura
2009/0287451 A1* 11/2009 Sato ..... E21B 47/022 33/313
2011/0203846 A1* 8/2011 Degrange ..... G01V 1/46 175/50

(Continued)

FOREIGN PATENT DOCUMENTS

EP 1222361 B1 9/2004
WO 2009138842 A1 11/2009

*Primary Examiner* — Christopher J Sebesta
*Assistant Examiner* — Yanick A Akaragwe
(74) *Attorney, Agent, or Firm* — Abel Schillinger, LLP

(57) ABSTRACT

A method for determining gravity toolface azimuth that can include rotating a logging tool about a center axis; positioning an accelerometer sensor within the logging tool at a first radial distance from the center axis; positioning an angular gyroscope sensor within the logging tool at a second radial distance from the center axis; receiving, at a controller, accelerometer sensor data from the accelerometer sensor and angular gyroscope sensor data from the angular gyroscope sensor as the logging tool rotates; determining, via the controller, a radial acceleration component of the accelerometer sensor from the accelerometer sensor data; determining, via the controller, a gain and an offset of the angular gyroscope sensor based on the radial acceleration component; and determining, via the controller, the gravity toolface azimuth of the logging tool as a function of time based on the gain, the offset, and the angular gyroscope sensor data.

20 Claims, 10 Drawing Sheets

(56) References Cited

U.S. PATENT DOCUMENTS

| | | | | |
|---|---|---|---|---|
| 2015/0211352 | A1* | 7/2015 | Sugiura | E21B 44/00 175/27 |
| 2018/0180418 | A1* | 6/2018 | Estes | E21B 49/003 |
| 2020/0116010 | A1 | 4/2020 | Gillan | |
| 2021/0048357 | A1* | 2/2021 | Arevalo | G01L 5/00 |

* cited by examiner

SECTION 3-3

SECTION 3-3

SECTION 3-3

GRAVITY TOOLFACE FOR WELLBORES

CROSS-REFERENCE TO RELATED APPLICATION(S)

This application claims priority under 35 U.S.C. § 119(e) to U.S. Patent Application No. 63/261,932, entitled "GRAVITY TOOLFACE FOR WELLBORES," by Dmitry AVDEEV, filed Sep. 30, 2021, which application is assigned to the current assignee hereof and incorporated herein by reference in its entirety.

TECHNICAL FIELD

The present invention relates, in general, to the field of drilling and processing of wells. More particularly, present embodiments relate to a system and method for calculating a toolface of a BHA or other downhole tool in a wellbore during and after subterranean operations.

BACKGROUND

Azimuthal logging-while-drilling (LWD) ultrasonic tools are widely used to deliver high-resolution amplitude images of wellbore walls. Underlying requirements for the detailed resolution of the images dictate a need for very accurate detection of the gravity toolface azimuth. Some M/LWD downhole assemblies utilize gyroscopes, magnetometers, and accelerometers for determining the well inclination, azimuth, and the assembly toolface azimuth. In open holes, the azimuthal LWD ultrasonic tools rely mostly on the magnetometers for providing the toolface azimuth. In cased holes and in open holes near the shoe, the magnetometers detect interference of the metal casing and may fail to deliver the true toolface azimuth due to a distortion of the earth's magnetic field by the metal casing. Therefore, improvements in calculating gravity toolface azimuth are continually needed.

SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method for determining gravity toolface azimuth. The method also includes rotating a logging tool about a center axis; positioning an accelerometer sensor within the logging tool at a first radial distance from the center axis; positioning an angular gyroscope sensor within the logging tool at a second radial distance from the center axis; receiving, at a controller, accelerometer sensor data from the accelerometer sensor and angular gyroscope sensor data from the angular gyroscope sensor as the logging tool rotates; determining, via the controller, a radial acceleration component of the accelerometer sensor from the accelerometer sensor data; determining, via the controller, a gain and an offset of the angular gyroscope sensor based on the radial acceleration component; and determining, via the controller, the gravity toolface azimuth of the logging tool as a function of time based on the gain, the offset, and the angular gyroscope sensor data. Other embodiments of this aspect include corresponding computer systems, apparatus, and computer programs recorded on one or more computer storage devices, each configured to perform the actions of the methods.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

Figure 1:
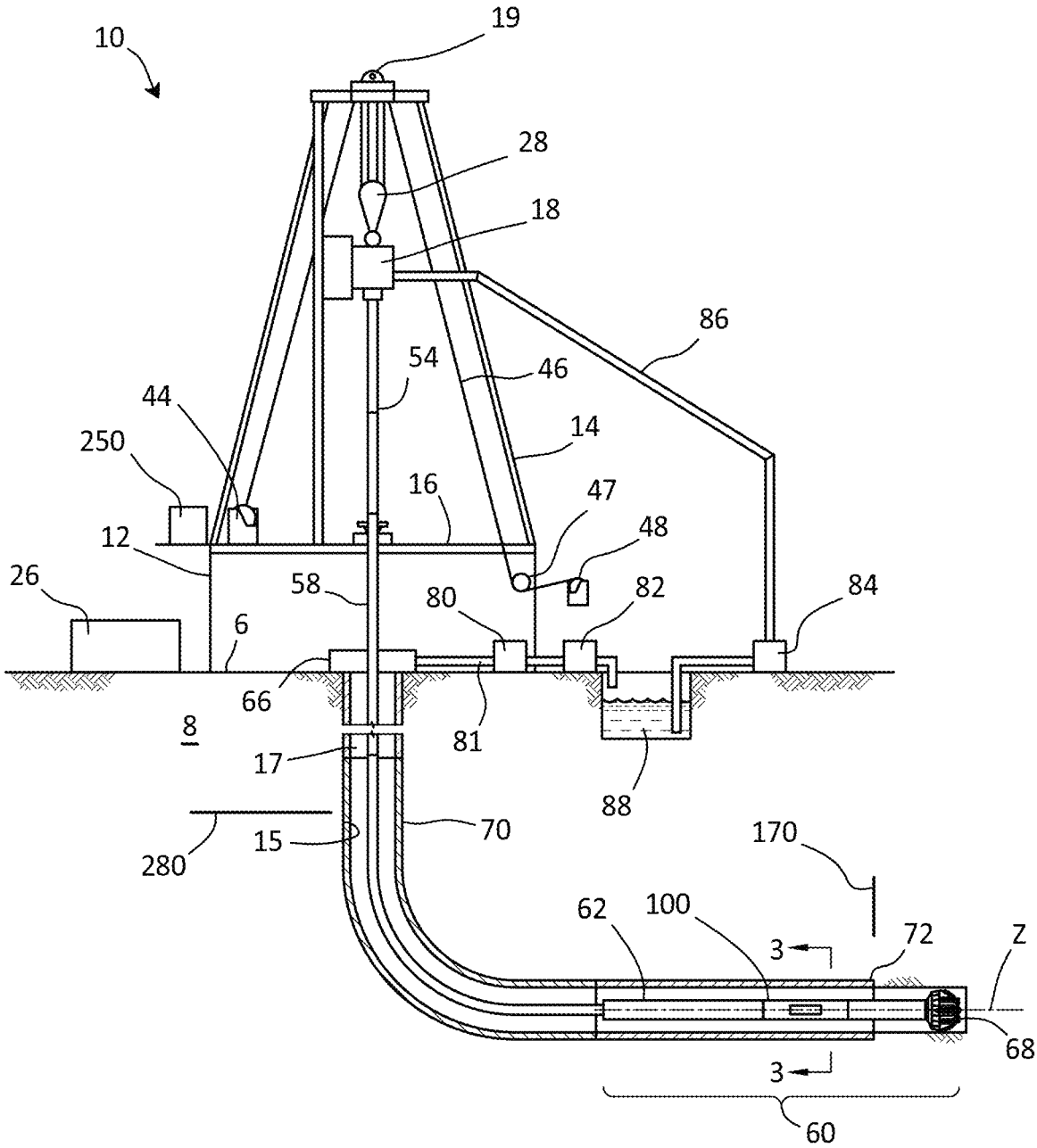
FIG. 1 is a representative simplified front view of a rig being utilized for a subterranean operation, in accordance with certain embodiments.

FIG. 1 is a representative partial cross-sectional view of a rig 10 being used to drill a wellbore 15 in an earthen formation 8. FIG. 1 shows a land-based rig, but the principles of this disclosure can equally apply to off-shore rigs, as well, where "off-shore" refers to a rig with water between the rig floor and the earth surface 6. The rig 10 can include a top drive 18 with a drawworks 44, sheaves 19, traveling block 28, anchor 47, and reel 48 used to raise or lower the top drive 18. A derrick 14 extending from the rig floor, can provide the structural support of the rig equipment for performing subterranean operations (e.g., drilling, treating, completing, producing, testing, etc.). The rig can be used to extend a wellbore 15 through the earthen formation 8 by using a drill string 58 having a Bottom Hole Assembly (BHA) 60 at its lower end. The BHA 60 can include a drill bit 68 and multiple drill collars 62, with one or more of the drill collars including a logging tool 100 for Logging While Drilling (LWD) or Measuring While Drilling (MWD) operations. During drilling operations, drilling mud can be pumped from the surface 6 into the drill string 58 (e.g., via pumps 84 supplying mud to the top drive 18) to cool and lubricate the drill bit 68 and to transport cuttings to the surface via an annulus 17 between the drill string 58 and the wellbore 15.

The returned mud can be directed to the mud pit 88 through the flow line 81 and the shaker 80. A fluid treatment 82 can inject additives as desired to the mud to condition the mud appropriately for the current well activities and possibly future well activities as the mud is being pumped to the mud pit 88. The pump 84 can pull mud from the mud pit 88 and drive it to the top drive 18 to continue circulation of the mud through the drill string 58.

The tubular string 58 can extend into the wellbore 15, with the wellbore 15 extending through the surface 6 into the subterranean formation 8. With a segmented tubular string 58, when tripping the tubular string 58 into the wellbore 15, tubulars 54 are sequentially added to the tubular string 58 to extend the length of the tubular string 58 into the earthen formation 8. With the tubular string 58 is a wireline or coiled tubing, the tubular string 58 can be uncoiled from a spool and extended into the wellbore 15. With the segmented tubular string 58, when tripping the tubular string 58 out of the wellbore 15, tubulars 54 are sequentially removed from the tubular string 58 to reduce the length of the tubular string 58 extending into the earthen formation 8. With a wireline or coiled tubing tubular string 58, the tubular string 58 can be coiled onto a spool when being pulled out of the wellbore 15.

The wellbore 15 can have casing string 70 installed in the wellbore 15 and extending down to the casing shoe 72. The portion of the wellbore 15 with the casing string 70 installed, can be referred to as a cased wellbore. The portion of the wellbore 15 below the shoe 72, without casing, can be referred to as an "uncased" or "open hole" wellbore.

A rig controller 250 can be used to control the rig 10 operations including controlling various rig equipment, such as a pipe handler (not shown), a top drive 18, an iron roughneck (not shown), fingerboard equipment (not shown), imaging systems, various other robots on the rig 10 (e.g., a drill floor robot), or rig power systems 26. The rig controller 250 can control the rig equipment autonomously (e.g., without periodic operator interaction,), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation).

The rig controller 250 can include one or more processors with one or more of the processors distributed about the rig 10, such as in an operator's control hut, in the pipe handler, in the iron roughneck, in a vertical storage area (not shown), in the imaging systems, in various other robots, in the top drive 18, at various locations on the rig floor 16 or the derrick 14 or the platform 12, at a remote location off of the rig 10, at downhole locations, etc. It should be understood that any of these processors can perform control or calculations locally or can communicate to a remotely located processor for performing the control or calculations. Each of the processors can be communicatively coupled to a non-transitory memory, which can include instructions for the respective processor to read and execute to implement the desired control functions or other methods described in this disclosure. These processors can be coupled via a wired or wireless network.

The rig controller 250 can collect data from various data sources around the rig and downhole (e.g., sensors, user input, local rig reports, etc.) and from remote data sources (e.g., suppliers, manufacturers, transporters, company men, remote rig reports, etc.) to monitor and facilitate the execution of the subterranean operation.

During the subterranean operation, such as drilling, various logging operations are generally performed to collect and store sensor data for later processing to provide visualization to parameters and characteristics of the wellbore and its surroundings. The processing can be performed by the rig controller 250 during the subterranean operation or after the subterranean operation is complete. A logging tool 100 can be included in the BHA 60 (or otherwise included in the tubular string 58) for performing logging or measuring operations at various times during the operation, or during the operation. The logging tool 100 can have a center longitudinal axis Z, which can also correspond to the longitudinal axis of the BHA 60. Some of the logging/measuring operations can be collecting downhole imagery of the wellbore 15 while the tubular string 58 is being rotated (such as for drilling, reaming, etc.).

Magnetometers can be used along with other sensors to collect data for the subterranean operation. The magnetometers work well in open hole portions of the wellbore 15, but do not work so well in the cased portions of the wellbore 15. The magnetometers can detect interference from the metal casing string 70 when the logging tool is positioned in the cased portions, or even when the tool is in the open hole portion that is near the shoe 72. This interference causes errors in calculations that are based on the reading from the magnetometers from in or near the casing.

As used herein, "gravity toolface" refers to the high side of the logging tool 100 or the tubular string 58 or the BHA 60. As used herein, "gravity toolface azimuth" refers to an azimuth (or angle) that the gravity toolface is rotated from a top center of the wellbore 15 relative to gravity. The current disclosure provides methods and system that can determine the gravity toolface azimuth using an accelerometer and an angular gyroscope to collect sensor data regarding the rotation of the logging tool 100. Magnetometers are not used to collect sensor data and are not needed to determine the gravity toolface azimuth when using the systems and methods of the current disclosure.

The current disclosure provides one or more solutions for supplying sensor data from within or nearby the casing 70 and calculating the gravity toolface to support high-resolution construction of imagery that is collected downhole while the tubular string 58 is being rotated in a wellbore 15. The downhole imagery can be constructed without errors caused by interference with the metal casing string 70. Therefore, the current disclosure provides accurate calculations of the gravity toolface azimuth from sensor data that is collected while the logging tool 100 is positioned within either cased or open hole portions of the wellbore 15, and while the tubular string 58 is rotating.

As stated above, azimuthal LWD ultrasonic tools are widely used to deliver high-resolution images of wellbore walls. Constructing these images are highly dependent upon accurate calculations of the gravity toolface azimuth, which can be significantly impacted when the logging tool 100 is positioned in or near the metal of the casing string 70. This can be illustrated by comparing the images shown in FIGS. 2A and 2B of the same wellbore 15 based on different gravity toolface calculations.

Figure 2A:
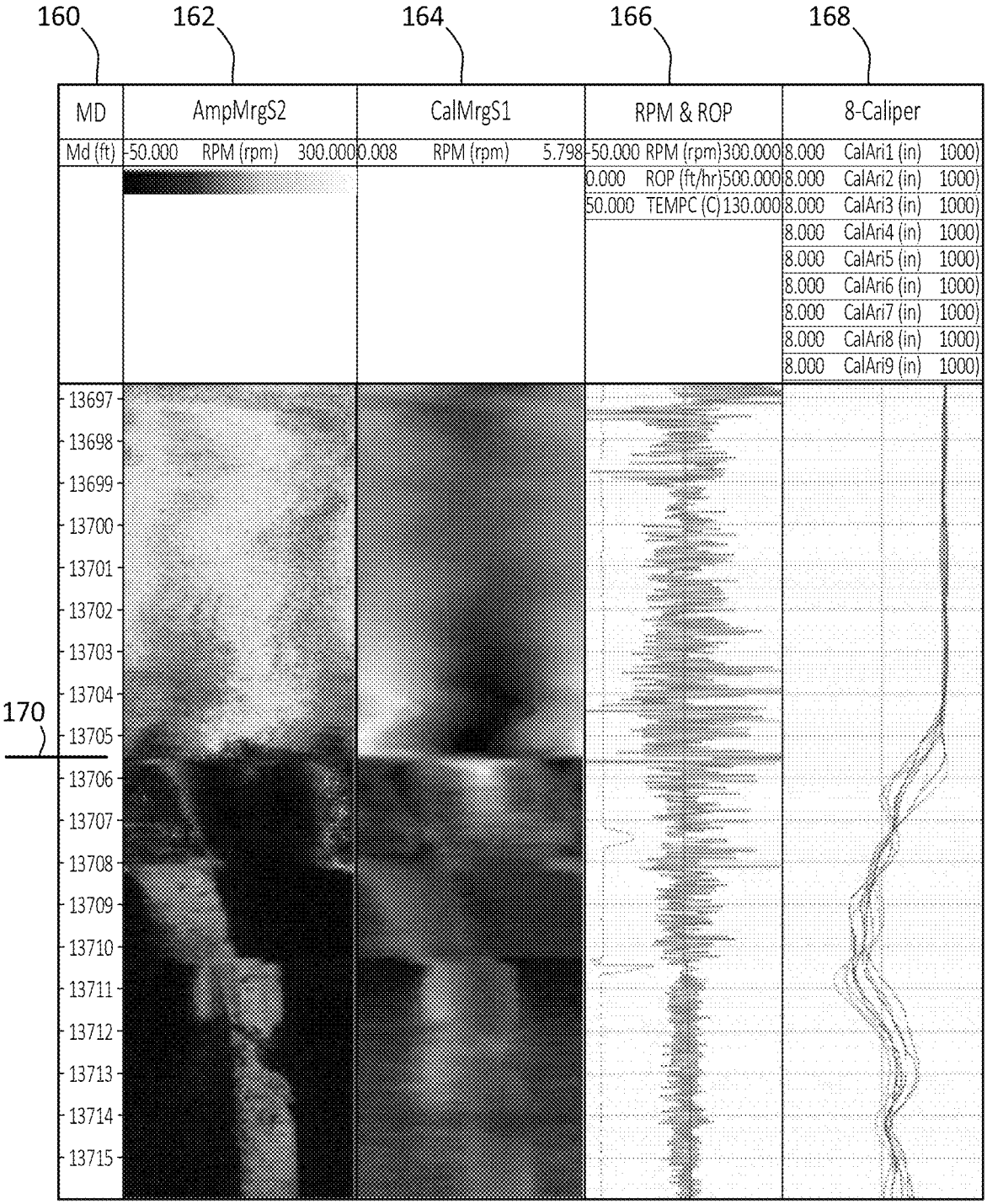
FIGS. 2A and 2B are representative images of a wellbore at the end of a casing string, where the image in FIG. 2A is constructed based on the gravity toolface calculated via conventional methods, and where the image in FIG. 2B is constructed based on the gravity toolface calculated via the methods of the current disclosure.
Figure 2B:
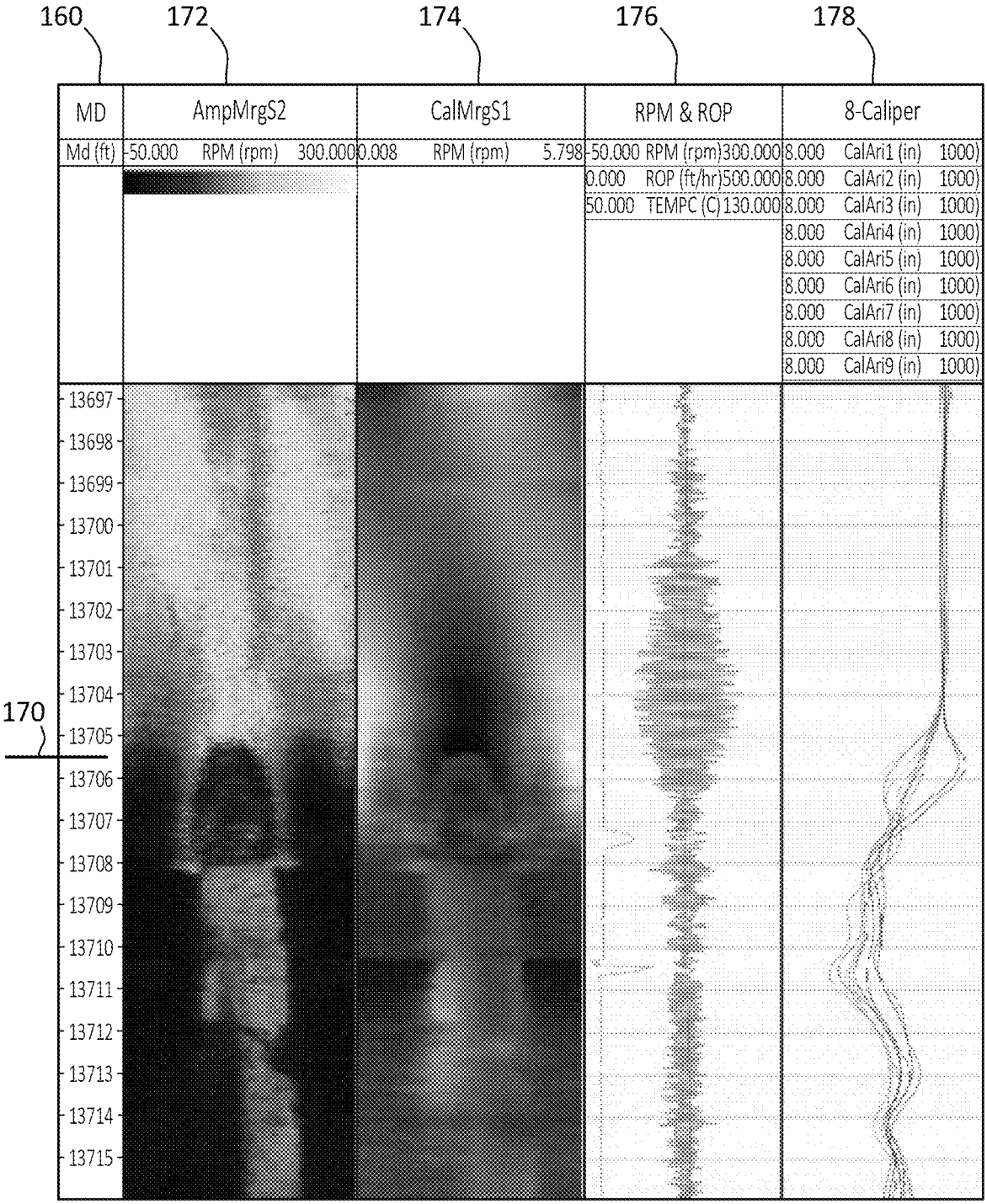

FIGS. 2A and 2B are representative images of a wellbore 15 at the end of a casing string 70, where the images in FIG. 2A are constructed based on the gravity toolface azimuth calculated via conventional methods, and where the images in FIG. 2B are constructed based on the gravity toolface azimuth calculated via the methods of the current disclosure.

FIG. 2A contains images and logs of the wellbore 15 from a measured depth (MD) of ~13,697 ft. to a MD of ~13.716 ft. based on sensor data from a FRACVIEW™ high-resolution logging while drilling (LWD) sonic tool from Petromar, a Nabors Company. The shoe 72 of the casing 70 is positioned at the MD of ~13.705 ft. as indicated by reference numeral 170. FIG. 2A includes the Amplitude S2 Image 162, a Caliper S1 image 164, a log 166 of the revolutions per minute (RPM) and rate of penetration (ROP) of the tubular string 58, and an 8-caliper log 168 for the case when magnetometer readings were used to find the gravity toolface azimuth.

FIG. 2B contains images and logs of the wellbore 15 from a measured depth (MD) of ~13.697 ft. to a MD of ~13.716 ft. based on sensor data from the high-resolution logging while drilling (LWD) sonic tool based on the current disclosure. The shoe 72 of the casing 70 is positioned at the MD of ~13.705 ft. as indicated by reference numeral 170. FIG. 2B includes the Amplitude S2 Image 172, a Caliper S1 image 174, a log 176 of the revolutions per minute (RPM) and rate of penetration (ROP) of the tubular string 58, and an 8-caliper log 178 for the case when the systems and methods of the current disclosure were used to find the gravity toolface azimuth.

As can be seen when comparing the images and logs of FIG. 2A to the images and logs of FIG. 2B, the systems and methods of the current disclosure provide superior images and logs when compared to the conventional method both within the casing 70 and below the casing shoe 72 (see reference 170 in FIG. 1 and FIG. 2A).

Figure 3:
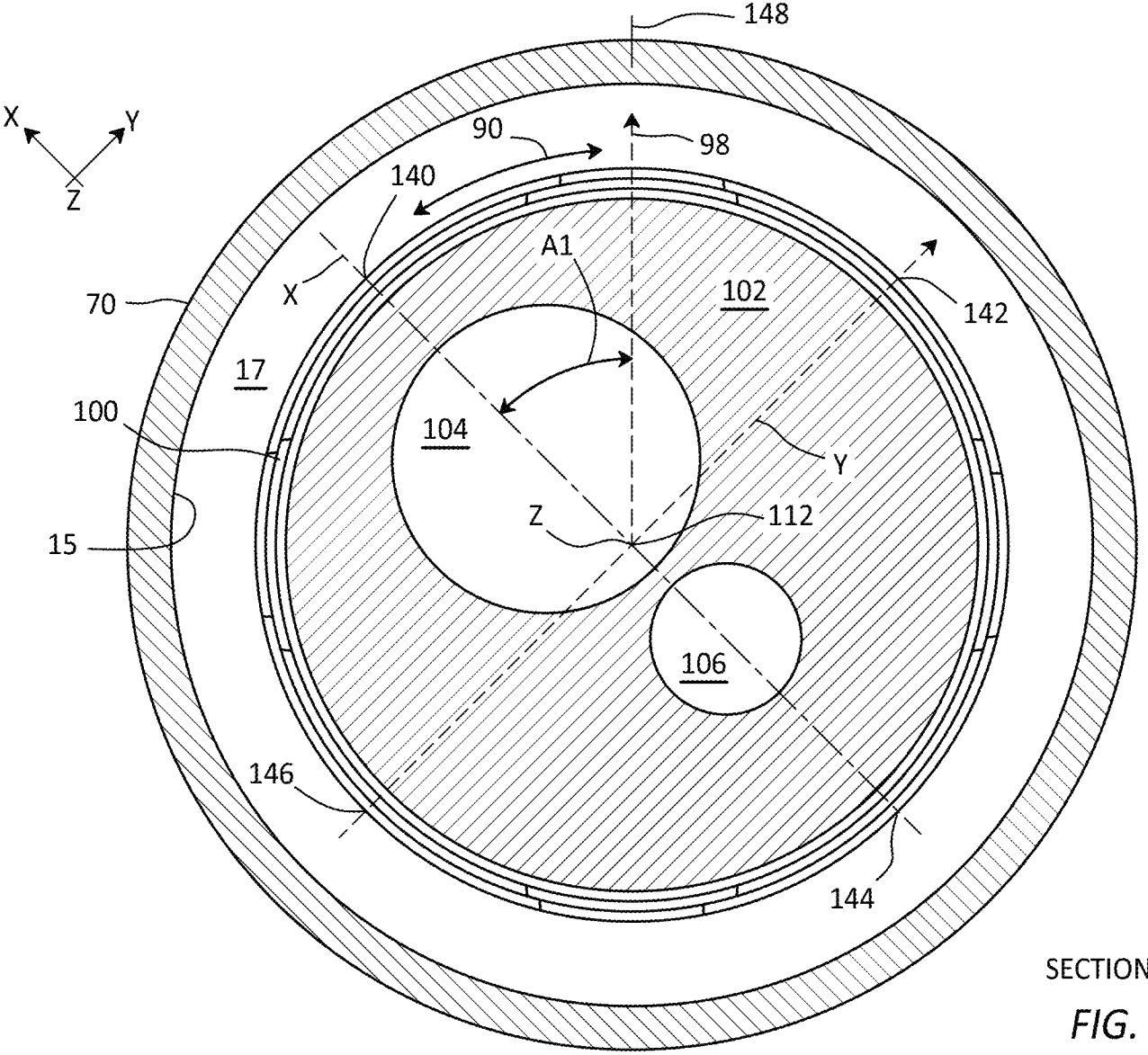
FIGS. 3-6 are representative partial cross-sectional views 3-3, as indicated in FIG. 1, of a logging tool in a cased wellbore, in accordance with certain embodiments.

In a non-limiting embodiment, FIG. 3 is a representative partial cross-sectional view along line 3-3, as indicated in FIG. 1, of a logging tool 100 in a cased wellbore 15. The logging tool 100 is shown positioned inside a casing 70 with an annulus 17 between them and rotated (arrows 90) to an angle A1 from the top side 148 of the wellbore 15. The logging tool 100 can rotate (arrows 90) in either direction within the wellbore 15. The angle A1 can be seen as the gravity toolface azimuth A1 since it indicates the angle from the top side 148 (arrows 98) of the wellbore 15 to the high side 140 (or gravity toolface 140) of the logging tool 100, which has been rotated in the wellbore 15. The logging tool 100 can include a body 102 with a longitudinal flow passage 106 for the passage of mud through the logging tool 100, such as if the logging tool is assembled in a BHA 60. This longitudinal flow passage 106 can be positioned at other locations through the body 102 and it is not limited to the location shown. A longitudinal cavity 104 can also be formed in the body 102 to receive electronics for tool sensing and control.

As used herein, the X-Y-Z coordinate system used in the discussions below is relative to the high side 140, right side 142, low side 144, and left side 146 of the logging tool 100, as indicated by the X and Y axes.

Figure 4:
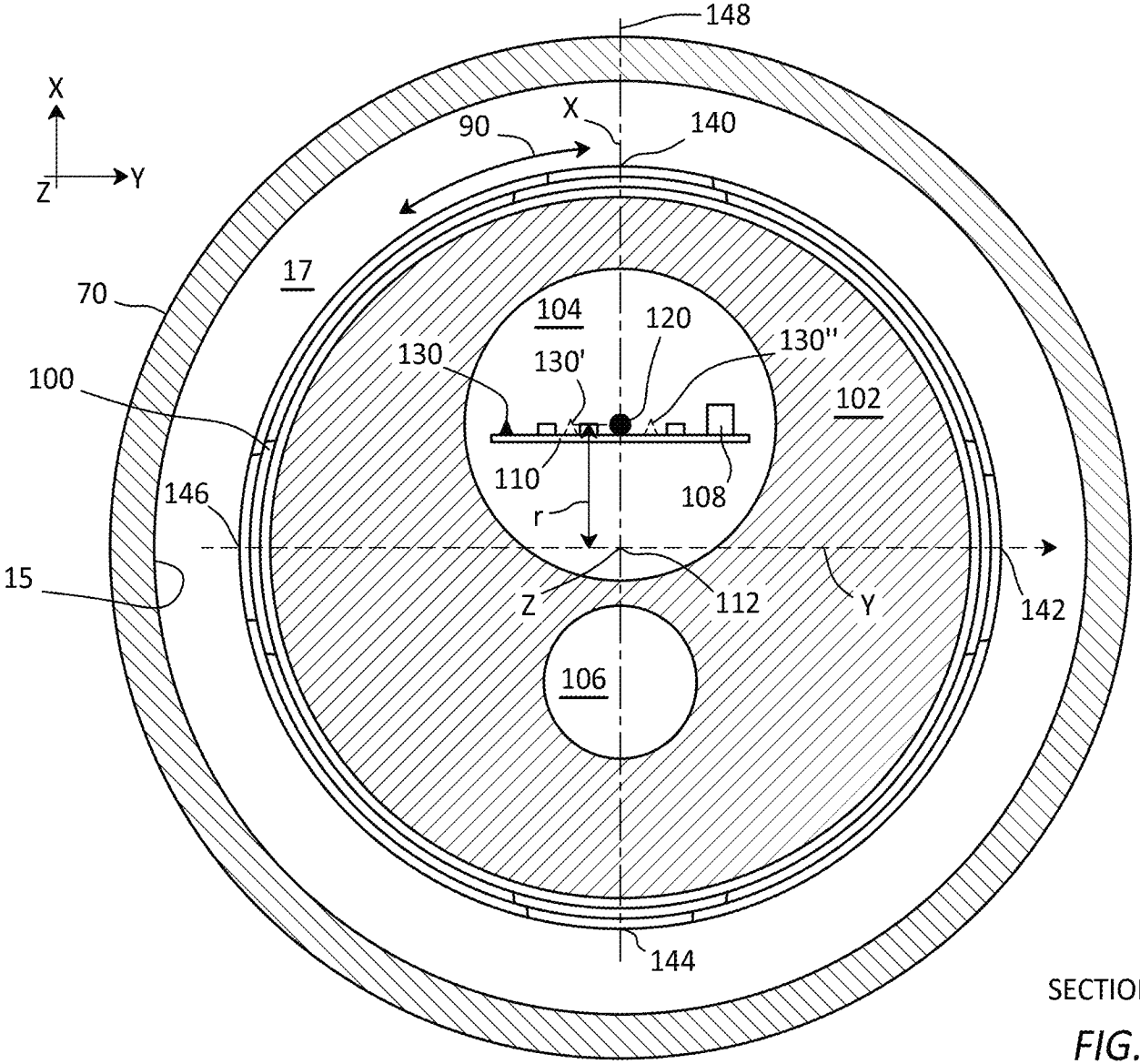

In a non-limiting embodiment, FIG. 4 is a representative partial cross-sectional view along line 3-3, as indicated in FIG. 1, of a logging tool 100 in a cased wellbore 15. The logging tool 100 is shown positioned inside a casing 70 with an annulus 17 between them. It should be understood that the systems and methods described in this disclosure can be used in cased portions or uncased portions of the wellbore 15. The logging tool 100 can include a body 102 with a longitudinal flow passage 106 for the passage of mud through the logging tool 100, such as if the logging tool is assembled in a BHA 60. This longitudinal flow passage 106 can be positioned at other locations through the body 102 and it is not limited to the location shown. A longitudinal cavity 104 can also be formed in the body 102 to receive electronics 108 mounted to a printed circuit board PCB 110. Appropriate structure (not shown for clarity) can be included to hold the electronics 108 in a desired position within the longitudinal cavity 104. The electronics can include one or more processors that are communicatively coupled to non-transitory memory device(s) for running software programs, whose instructions can be stored in the memory device(s) and retrieved as needed. The processors can receive data from sensors (e.g., 120, 130) mounted to the PCB and process the sensor data or transmit the sensor data to a controller that is remote from the logging tool 100.

The body 102 of the logging tool 100 can have a center axis Z that intersects an X-axis and a Y-axis at the intersection point 112. This forms an X-Y-Z coordinate system that will be used for discussion purposes to describe the current methods for calculating the gravity toolface azimuth A1. The high side 140 can be referred to as the gravity toolface 140, and the gravity toolface azimuth A1 can be seen as rotation of the high side 140 from the top side 148 of the wellbore 15.

The PCB 110 can include an accelerometer sensor 120 that can be positioned on the X-axis. The PCB 110 can also include an angular gyroscope sensor 130 positioned as shown or can be located on the PCB 110 at other positions, such as positions 130' or 130". In this non-limiting embodiment, the accelerometer sensor 120 and the angular gyroscope 130 can be used to collect sensor data while the logging tool 100 is rotated within the wellbore 15, with the logging tool 100 positioned within or near the casing 70, where the sensor data can be used to calculate the gravity toolface azimuth A1 (or φ) either by processors downhole, at the surface 6, on or near a rig 10, or remote from the rig 10.

It can be shown that the downhole MWD/LWD logging tool 100 accelerometer sensor 120 readings $accel_x$ and $accel_y$ can be expressed as the following.

$$\begin{cases} accel_x = a_x + \hat{g}\cdot\cos(\varphi) + r\cdot\dot{\varphi}^2 + a_x^0 \\ accel_x = a_y - \hat{g}\cdot\sin(\varphi) - r\cdot\ddot{\varphi} + a_y^0 \end{cases} \quad (1)$$

Where $a_x$ and $a_y$ are the radial and tangential accelerations of the logging tool 100 as a whole, $\hat{g}\cos(\varphi)$ and $\hat{g}\sin(\varphi)$ are the gravity components, factor $\hat{g}$ depends on the well inclination $$\left(0 \le \hat{g} \le 9.81\frac{m}{s2}\right),\ r\dot{\varphi}^2$$

is the centripetal acceleration of the logging tool 100 and $\ddot{\varphi}$ is its Euler acceleration, $a_x^0$ and $a_y^0$ are the sensor offsets for sensor 120, r is the radial distance of the accelerometer sensor 120 from the center axis Z (or intersection point 112), and $\varphi$ is the gravity toolface azimuth. It can be assumed that the gravity toolface azimuth is zero ($\varphi$=0) when the accelerometer sensor 120 is rotationally positioned at the top side 148 of the wellbore 15.

To simplify Equation (1), a low-pass filter (LPF) can be applied to all terms of the equation. This simple filtering allows dramatic reduction, or even elimination, of an impact of the terms $a_x$ and $a_y$. With the LPF cut-off, $f_{cutoff}$, chosen such that $$f_{cutoff} >> \frac{\text{RPM}}{60}\text{[Hz]},$$

the original Equations (1) can be written as Equations (2) with the filtered terms keeping the same notation.

$$\begin{cases} accel_x = \hat{g}\cdot\cos(\varphi) + r\cdot\dot{\varphi}^2 + a_x^0 \\ accel_x = -\hat{g}\cdot\sin(\varphi) - r\cdot\ddot{\varphi} + a_y^0 \end{cases} \quad (2)$$

For many MWD/LWD operations the logging tool RPM may not exceed values of 200 to 300, so $f_{cutoff}$=10 [Hz] can satisfy these MWD/LWD operations.

Furthermore, the angular gyroscope sensor 130 of the MWD/LWD logging tool 100 can provide angular rate sensing, with its readings gyro, being written as following:

$$\text{gyro}=\alpha\dot{\varphi}+\beta, \quad (3)$$

where coefficients $\alpha$ and $\beta$ are a sensor gain and offset respectively. By nature of the gyro sensors, both coefficients $\alpha$ and $\beta$ can be prone to instability downhole, such as changing with temperature. Therefore, true values of the angular speed, $\dot{\varphi}$, and the coefficients $\alpha$ and $\beta$ can be detected from an independent dataset, such as using Equation (2). The $accel_x$ readings of the first of Equations (2) will allow the coefficients $\alpha$ and $\beta$ to be determined as a function of time or depth.

Integrating Equation (3) and substituting it into the first of Equation (2) yields:

$$accel_x(t) = \hat{g}\cdot\cos\left(\gamma + \int_{t_0}^{\tau}\frac{gyro(\tau)-\beta}{\alpha}d\tau\right) + a_x^0 + r\left(\frac{gyro(\tau)-\beta}{\alpha}\right)^2 \quad (4)$$

where $t_0 \le t \le t_0+\Delta T$. Assuming that $\alpha$, $\beta$, and $\gamma$ do not practically change within the time segment $[t_0, t_0+\Delta T]$, assumptions can be made for small $\Delta T$, such as $\Delta T$=1 [min]. For each consecutive time segment, the coefficients $\alpha$, $\beta$, and $\gamma$ can be determined from minimization of the following:

$$\frac{1}{\Delta T}\int_{t_0}^{\tau_0+\Delta T} \left|accel_x(t) - \hat{g}\cdot\cos\left(\gamma + \int_{t_0}^{\tau}\frac{gyro(\tau)-\beta}{\alpha}d\tau\right) - a_x^0 - r\left(\frac{gyro(t)-\beta}{\alpha}\right)^2\right|^2 dt \xrightarrow{\alpha,\beta,\gamma} \min \quad (5)$$

When the minimization of Equation (5) is performed, and coefficients $\alpha$, $\beta$, and $\gamma$ are determined, the gravity toolface azimuth, $\varphi$, at the segment $[t_0, t_0+\Delta T]$ can be calculated from the following equation:

$$\varphi(t) = \gamma + \int_{t_0}^{\tau}\frac{gyro(\tau)-\beta}{\alpha}d\tau \quad (6)$$

As shown, Equations (4) and (5) demonstrate how a single axis sensor (i.e., an X-axis sensor) of the accelerometer sensor 120 measuring only the X-axis acceleration can be used for detection of the angular gyroscope sensor 130 gain and offset, and determination of the true gravity toolface azimuth can be performed by the numerical integration of Equation (6). With the gravity toolface azimuth determined as a function of time, the rig controller 250 can correlate the gravity toolface azimuth with imagery and log data to construct the images and logs such as in FIGS. 2B and 8B.

Figure 5:
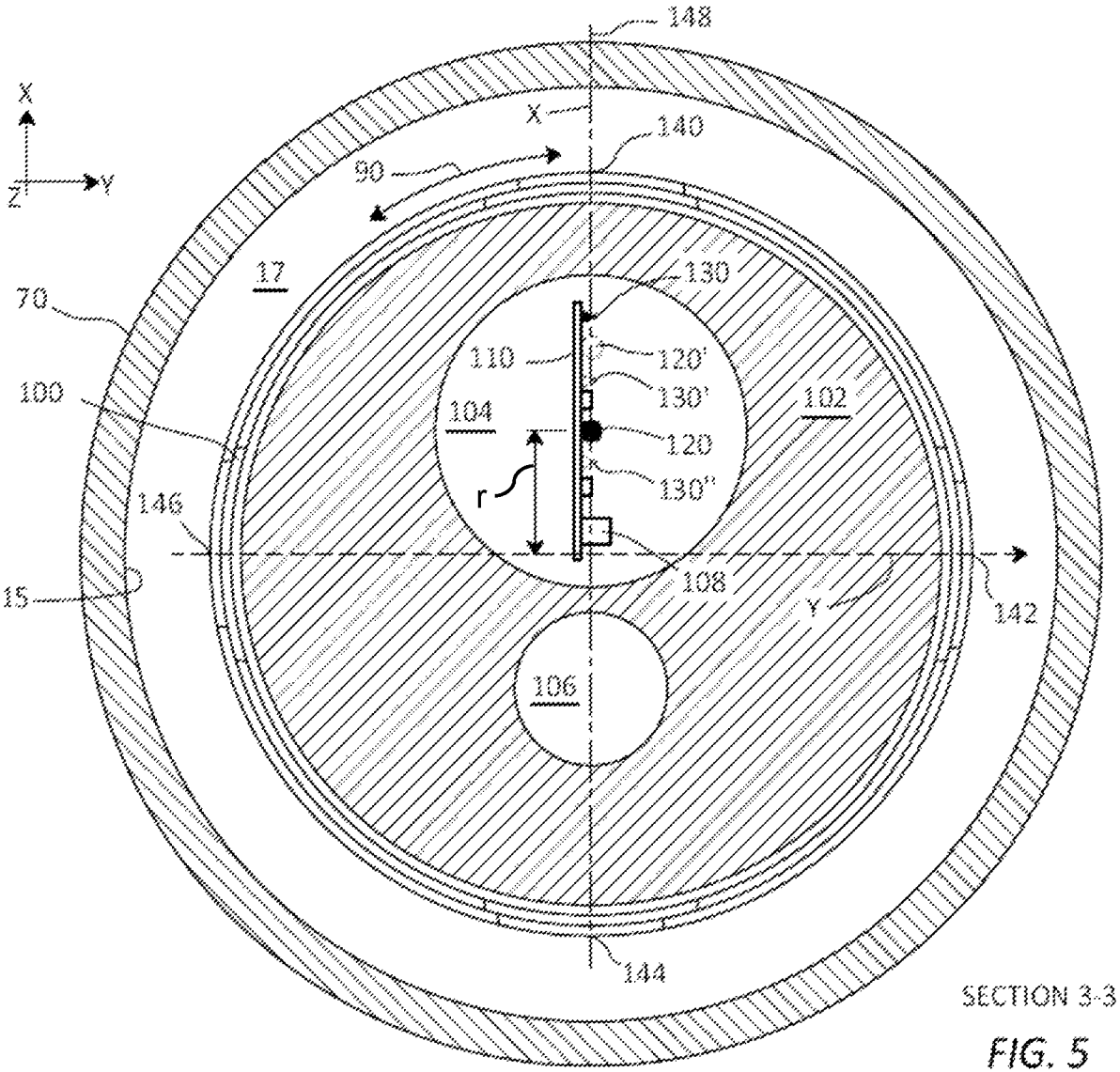

In a non-limiting embodiment, FIG. 5 is a representative partial cross-sectional view along line 3-3, as indicated in FIG. 1, of a logging tool 100 in a cased wellbore 15. The logging tool 100 is shown positioned inside a casing 70 with an annulus 17 between them. The logging tool 100 can include a body 102 with a longitudinal flow passage 106 for the passage of mud through the logging tool 100, such as if the logging tool is assembled in a BHA 60. This longitudinal flow passage 106 can be positioned at other locations through the body 102 and it is not limited to the location shown. A longitudinal cavity 104 can also be formed in the body 102 to receive electronics 108 mounted to a printed circuit board PCB 110. Appropriate structure (not shown for clarity) can be included to hold the electronics 108 in a desired position within the longitudinal cavity 104. The electronics can include one or more processors that are communicatively coupled to non-transitory memory device (s) for running software programs, whose instructions can be stored in the memory device(s) and retrieved as needed. The processors can receive data from sensors (e.g., 120, 130) mounted to the PCB and process the sensor data or transmit the sensor data to a controller that is remote from the logging tool 100.

The body 102 of the logging tool 100 can have a center axis Z that intersects an X-axis and a Y-axis at the intersection point 112. This forms an X-Y-Z coordinate system that will be used for discussion purposes to describe the current methods for calculating the gravity toolface azimuth A1. The high side 140 can be referred to as the gravity toolface 140, and the gravity toolface azimuth A1 can be seen as rotation of the high side 140 from the top side 148 of the wellbore 15.

The PCB 110 can include an accelerometer sensor 120 that can be positioned on the X-axis. The PCB 110 can also include an angular gyroscope sensor 130 positioned as shown or can be located on the PCB 110 at other positions, such as positions 130' or 130". In this non-limiting embodiment, the accelerometer sensor 120 and the angular gyroscope 130 can be used to collect sensor data while the logging tool 100 is rotated within the wellbore 15, with the logging tool 100 positioned within or near the casing 70, where the sensor data can be used to calculate the gravity toolface azimuth A1 (or φ) either by processors downhole, at the surface 6, on or near a rig 10, or remote from the rig 10.

FIG. 5 is of a similar configuration of the logging tool 100 as shown in FIG. 4, except that the PCB 110 is mounted in the cavity 104 in an orientation that is substantially perpendicular to the PCB 110 orientation in FIG. 4. However, since the accelerometer sensor 120 is still positioned on the X-axis, the X-axis acceleration, along with the readings from the angular gyroscope sensor 130, can be used to determine the gravity toolface azimuth A1 as a function of time, as described above with reference to Equations. (1)-(6). In this configuration, the accelerometer sensor 120 can be positioned at other positions along the PCB 110, such as position 120', without impacting the results of the Equations. (1)-(6).

Figure 6:
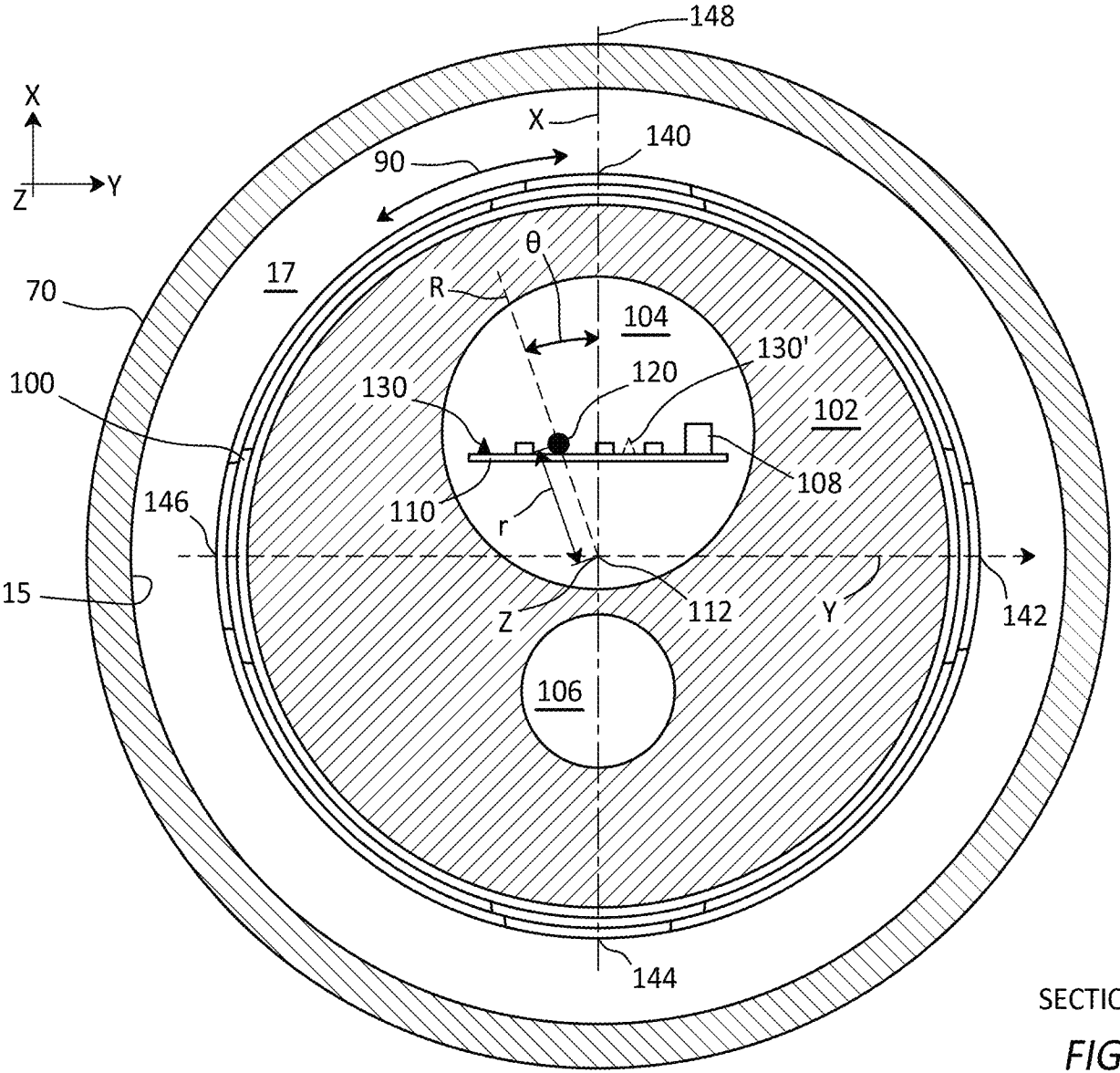

In a non-limiting embodiment, FIG. 6 is a representative partial cross-sectional view along line 3-3, as indicated in FIG. 1, of a logging tool 100 in a cased wellbore 15. The logging tool 100 is shown positioned inside a casing 70 with an annulus 17 between them. The logging tool 100 can include a body 102 with a longitudinal flow passage 106 for the passage of mud through the logging tool 100. This longitudinal flow passage 106 can be positioned at other locations through the body 102 and it is not limited to the location shown. A longitudinal cavity 104 can also be formed in the body 102 to receive electronics 108 of the logging tool 100 mounted to a printed circuit board PCB 110. Appropriate structure (not shown for clarity) can be included to hold the electronics 108 in a desired position within the longitudinal cavity 104. The electronics can include one or more processors that are communicatively coupled to non-transitory memory device(s) for running software programs, whose instructions are stored in the memory device(s). The processors can receive data from sensors mounted to the PCB and process the sensor data or transmit the sensor data to a controller that is remote from the logging tool 100.

The body 102 of the logging tool 100 can have a center axis Z that intersects an X-axis and a Y-axis at the intersection point 112. This forms an X-Y-Z coordinate system that will be used for discussion purposes to describe the current methods for calculating the gravity toolface azimuth using the configuration of the logging tool 100 shown in FIG. 6. The high side 140 can be referred to as the gravity toolface 140, and the gravity toolface azimuth can be seen as the rotation of the high side 140 from the top side 148 of the wellbore 15.

The PCB 110 can include an accelerometer sensor 120 that can detect acceleration in both the X and Y directions, which is needed if the sensor 120 is not positioned on the X-axis. The PCB 110 can also include an angular gyroscope sensor 130 positioned as shown or can be located on the PCB 110 at other positions, such as location 130'. In this non-limiting embodiment, the accelerometer sensor 120 and the angular gyroscope sensor 130 can be used to collect sensor data while the logging tool 100 is rotated (arrows 90) within the wellbore 15, with the logging tool 100 positioned within or near the casing 70, where the sensor data can be used to calculate the gravity toolface azimuth A1 (or φ) either by processors downhole, at the surface 6, on or near a rig 10, or remote from the rig 10. Since the accelerometer sensor 120 is not positioned on the X-axis, the equations given above regarding FIG. 4, may be modified to determine the radial acceleration from using the acceleration components for both the X and Y axes.

Figure 7:
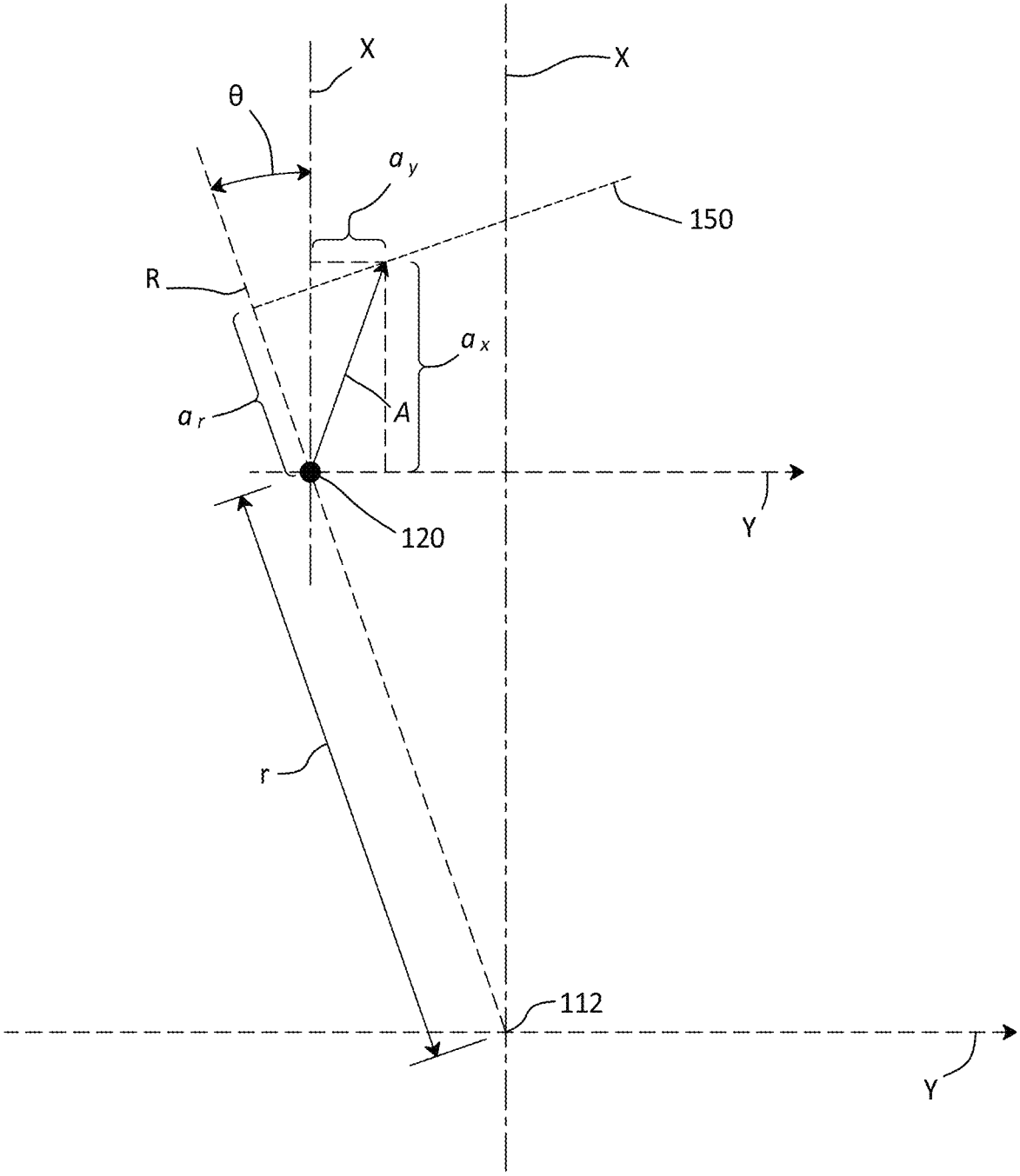
FIG. 7 is a spatial representation of adjustments needed when the accelerometers are not positioned on the X-axis, as illustrated in FIG. 6, in accordance with certain embodiments.

FIG. 7 shows a more detailed view of the geometries involved in calculating the gravity toolface azimuth using the readings of the accelerometer sensor 120 that is offset from the X-axis and the angular gyroscope sensor 130. As the logging tool 100 rotates in the wellbore 15, the accelerometer 120 can have an acceleration vector A as shown in FIG. 7. It is desirable to determine the radial acceleration component $a_r$ along the line R. To do this, the $a_x$ and $a_y$ acceleration components of the vector A can be determined from the X-axis and Y-axis accelerations which can be measured by the accelerometer sensor 120. With the $a_x$ and $a_y$ acceleration components determined the following equation can be used to determine the radial acceleration component $a_r$ (or $\text{accel}_r$).

$$a_x \cos(\theta) - a_y \sin(\theta) = \text{accel}_r \tag{7}$$

where $a_x$ and $a_y$ are the acceleration components of the vector A and θ is the angle from R to the X-axis, Graphically speaking with reference to FIG. 7, the radial acceleration component $a_r$ can be determined by drawing a line 150, that is perpendicular to the line R, through the end point of the vector A. The intersection of the line 150 with the line R indicates the magnitude of the radial acceleration component $a_r$. With the radial acceleration component $a_r$. determined, a method similar to the one performed regarding FIG. 4 can be performed, but instead of using the first one of the equations (2), the following equation can be used:

$$\text{accel}_r = a_r + \hat{g} \cos(\varphi) + r\dot{\varphi}^2 + a_r^0 \tag{8}$$

Furthermore, the angular gyroscope sensor 130 of the MWD/LWD logging tool 100 can provide angular rate sensing as stated above, with its readings gyro, being written as Equation (3), which is repeated here for convenience:

$$\text{gyro} = \alpha\varphi + \beta \qquad \text{(3) copy}$$

where coefficients α and β are a sensor gain and offset respectively. By nature of the gyro sensors, both coefficients α and β can be prone to instability downhole, such as changing with temperature. Therefore, true values of the angular speed, $\dot{\varphi}$, the coefficients α and β can be detected from an independent dataset, such as using Equation (8). The calculated values for $\text{accel}_r$ of Equation (8) will allow the coefficients α and β to be determined as a function of time or depth.

Integrating Equation (3) and substituting it into Equation (8) yields:

$$accel_r(t) = \hat{g} \cdot \cos\left(\gamma + \int_{t_0}^{t} \frac{gyro(\tau) - \beta}{\alpha} d\tau\right) + a_r^0 + r\left(\frac{gyro(t) - \beta}{\alpha}\right)^2 \tag{9}$$

where $t_0 \le t \le t_0 + \Delta T$. Assuming that α, β, and γ do not practically change within the time segment $[t_0, t_0+\Delta T]$ can be made for small ΔT, such as ΔT=1 [min]. For each consecutive time segment, the coefficients α, β, and γ can be determined from minimization of the following:

$$\frac{1}{\Delta T}\int_{t_0}^{t_0+\Delta T} \left| accel_r(t) - \hat{g}\cdot\cos\left(\gamma + \int_{t_0}^{t}\frac{gyro(\tau)-\beta}{\alpha}d\tau\right) - a_r^0 - r\left(\frac{gyro(t)-\beta}{\alpha}\right)^2\right|^2 dt \xrightarrow{\alpha,\beta,\gamma} \min \tag{10}$$

When the minimization of Equation (10) is performed, and coefficients α, β, and γ are determined, the gravity toolface azimuth, φ, at the segment $[t_0, t_0+\Delta T]$ can be calculated from the following equation:

$$\varphi(t) = \gamma + \int_{t_0}^{t}\frac{gyro(\tau)-\beta}{\alpha}d\tau \tag{11}$$

As shown, Equations (9) and (10) demonstrate how an accelerometer sensor 120 that detects the X-axis and Y-axis accelerations can be used for detection of the angular gyroscope sensor 130 gain and offset, and determination of the true gravity toolface azimuth can be performed by the numerical integration of Equation (11). With the gravity toolface azimuth determined as a function of time, the rig controller 250 can correlate the gravity toolface azimuth with imagery and log data to construct the images and logs such as in FIGS. 2B and 8B.

If the accelerometer 120 were positioned anywhere in the 3D space in the body 102 of the logging tool 100, then an accelerometer 120 can measure acceleration components in the X, Y, and Z directions. With the acceleration components $a_x$, $a_y$, and $a_Z$ determined, (such as for a 3D vector A), the radial acceleration component $accel_r$ can be determined by simple rotation trigonometry. With $accel_r$ calculated, then equations (8)-(11) can be used to determine the true gravity toolface azimuth φ(t) as a function of time. With the gravity toolface azimuth determined as a function time, the rig controller 250 can correlate the gravity toolface azimuth with imagery and log data to construct the images and logs such as in FIG. 2B.

Figure 8A:
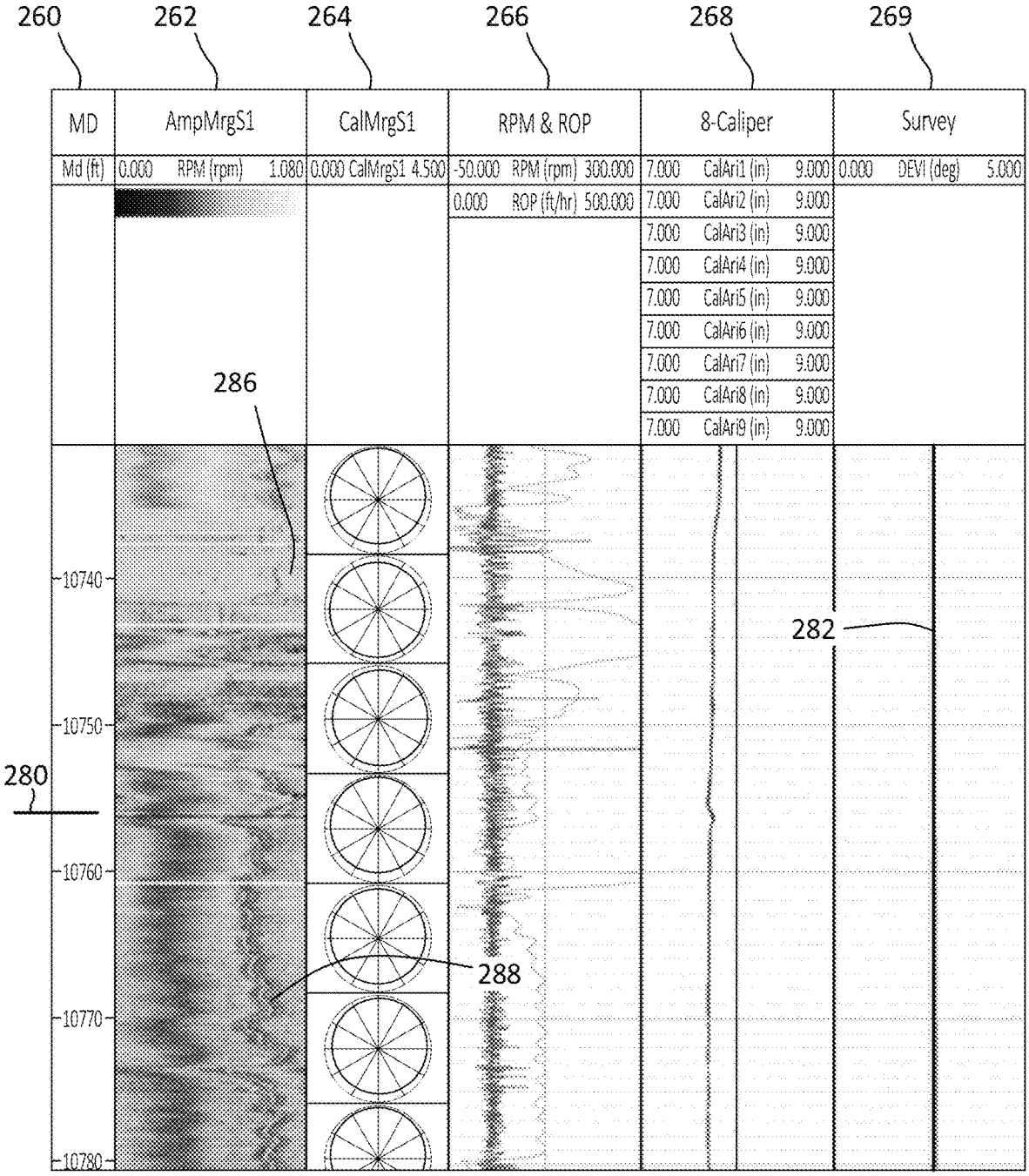
FIGS. 8A and 8B are representative images of a near vertical wellbore with a casing string installed, where the image in FIG. 8A is constructed based on the gravity toolface calculated via conventional methods, and where the image in FIG. 8B is constructed based on the gravity toolface calculated via the methods of the current disclosure.
Figure 8B:
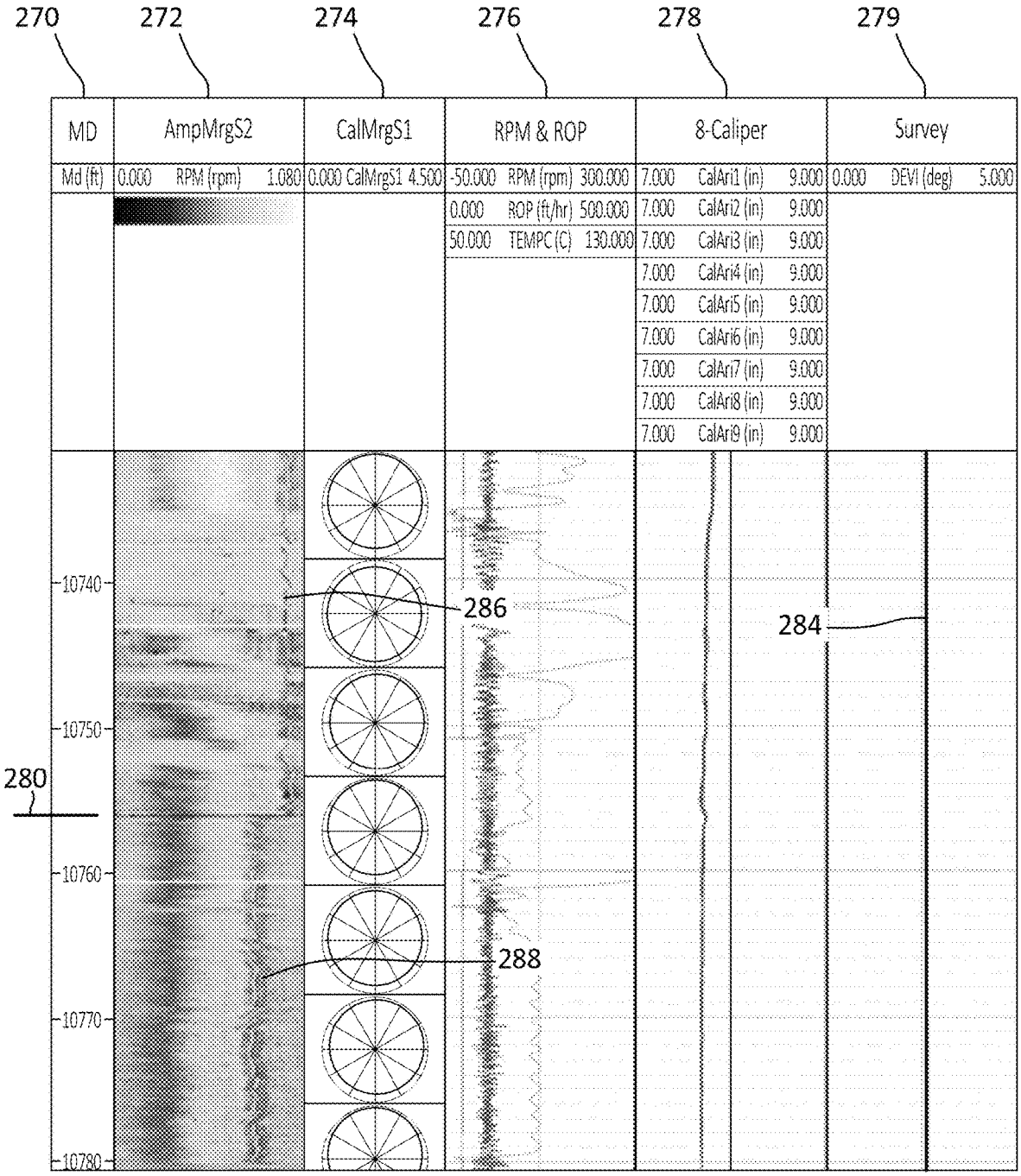

FIGS. 8A and 8B are representative images of a wellbore 15 at a location within a casing string 70 in a near-vertical portion of the wellbore 15, for example above and below location 280 (see reference to 280 in FIG. 1 as well), where the images in FIG. 8A are constructed based on the gravity toolface azimuth calculated via conventional methods, and where the images in FIG. 8B are constructed based on the gravity toolface azimuth calculated via the methods of the current disclosure.

FIG. 8A contains images and logs of the wellbore 15 from a measured depth (MD) 260 of ~10,730 ft. to a MD 260 of ~10,780 ft. based on sensor data from a FRACVIEW™ high-resolution logging while drilling (LWD) sonic tool from Petromar, a Nabors Company. The location 280 is shown (FIG. 1) in the vertical portion of the cased wellbore 15. FIG. 8A includes the Amplitude S1 Image 262, a Caliper S1 image 264, a log 266 of the revolutions per minute (RPM) and rate of penetration (ROP) of the tubular string 58, an 8-caliper log 268, and a Survey chart 269 that indicates the inclination of the wellbore to be at 2.5 degrees (line 282) from vertical, for the case when magnetometer readings were used to find the gravity toolface azimuth.

FIG. 8B contains images and logs of the wellbore 15 from a measured depth (MD) 270 of ~10,730 ft. to a MD 260 of ~10,780 ft. based on sensor data from the high-resolution logging while drilling (LWD) sonic tool based on the current disclosure. The location 280 is shown (FIG. 1) in the vertical portion of the cased wellbore 15. FIG. 8B includes the Amplitude S2 Image 272, a Caliper S1 image 274, a log 276 of the revolutions per minute (RPM) and rate of penetration (ROP) of the tubular string 58, an 8-caliper log 278, and a Survey chart 279 that indicates the inclination of the wellbore to be at ~2.5 degrees (line 284) from vertical, for the case when the systems and methods of the current disclosure were used to find the gravity toolface azimuth.

As can be seen when comparing the images and logs of FIG. 8A to the images and logs of FIG. 8B, that even for near vertical wellbores 15, such as shown here for a wellbore at an incline of ~2.5 degrees, the systems and methods of the current disclosure provide superior images and logs when compared to the conventional method within the casing 70. It can also be shown that the systems and methods of the current disclosure perform equally as well in cased or uncased portions of the wellbore 15, as well as in wellbore portions that are inclined between 1 degree up to 179 degrees from a vertical orientation (i.e., "0" zero degrees). The features indicated by numerals 286, 288 in image 272 are shown in sharper relief than the much more distorted versions of the features indicated by numerals 286, 288 in image 262.

The systems and methods of the current disclosure for determining the gravity toolface azimuth for rotating logging tools 100 in either cased or uncased wellbore portions can provide improved accuracy for gravity toolface azimuth calculations for sensor data collected in wellbore portions that are inclined at least 1 degree, at least 2 degrees, at least 2.5 degrees, at least 3 degrees, at least 4 degrees, at least 5 degrees, at least 6 degrees, at least 7 degrees, at least 8 degrees, at least 9 degrees, at least 10 degrees, at least 15 degrees, at least 20 degrees, at least 25 degrees, at least 30 degrees, at least 35 degrees, at least 40 degrees, at least 45 degrees, at least 50 degrees, at least 55 degrees, at least 60 degrees, at least 65 degrees, at least 70 degrees, at least 75 degrees, at least 80 degrees, at least 85 degrees, at least 90 degrees, at least 95 degrees, at least 100 degrees, at least 110 degrees, at least 120 degrees, at least 130 degrees, at least 140 degrees, at least 150 degrees, or at least 160 degrees.

The systems and methods of the current disclosure for determining the gravity toolface azimuth for rotating logging tools 100 in either cased or uncased wellbore portions can provide improved accuracy for gravity toolface azimuth calculations for sensor data collected in wellbore portions that are inclined up to 179 degree, up to 178 degrees, up to 177.5 degrees, up to 177 degrees, up to 176 degrees, up to 175 degrees, up to 174 degrees, up to 173 degrees, up to 172 degrees, up to 171 degrees, up to 170 degrees, up to 160 degrees, up to 150 degrees, up to 140 degrees, up to 130 degrees, up to 120 degrees, up to 110 degrees, or up to 100 degrees.

The systems and methods of the current disclosure for determining the gravity toolface azimuth for rotating logging tools 100 in either cased or uncased wellbore portions can provide improved accuracy for gravity toolface azimuth calculations for sensor data collected in wellbore portions that are inclined at an angle between 1 and 179 degrees, or between 2.5 and 177.5 degrees, between 1 and 100 degrees, or between 5 and 150 degrees.

VARIOUS EMBODIMENTS

Embodiment 1. A method for determining gravity toolface azimuth, the method comprising:

rotating a logging tool about a center axis;

positioning an accelerometer sensor within the logging tool at a first radial distance from the center axis;

positioning an angular gyroscope sensor within the logging tool at a second radial distance from the center axis;

receiving, at a controller, accelerometer sensor data from the accelerometer sensor and angular gyroscope sensor data from the angular gyroscope sensor as the logging tool rotates;

determining, via the controller, a radial acceleration component of the accelerometer sensor from the accelerometer sensor data;

determining, via the controller, a gain and an offset of the angular gyroscope sensor based on the radial acceleration component; and determining, via the controller, the gravity toolface azimuth of the logging tool as a function of time based on the gain, the offset, and the angular gyroscope sensor data.

Embodiment 2. The method of embodiment 1, wherein the controller is located at or near a rig that is performing a subterranean operation.

Embodiment 3. The method of embodiment 2, wherein the subterranean operation is drilling a wellbore.

Embodiment 4. The method of embodiment 3, wherein the logging tool stores the accelerometer sensor data and the angular gyroscope sensor data in the logging tool for later retrieval at the surface when the logging tool is pulled out of the wellbore.

Embodiment 5. The method of embodiment 4, wherein the accelerometer sensor data and the angular gyroscope sensor data are retrieved from the logging tool by rig equipment on a rig and transferred by rig equipment to a database for future processing or to the controller for real-time processing.

Embodiment 6. The method of embodiment 1, wherein the controller is located downhole with the logging tool in a wellbore.

Embodiment 7. The method of embodiment 6, wherein the controller determines the gravity toolface azimuth as a function of time and stores the gravity toolface azimuth in the logging tool downhole for later retrieval at the surface when the logging tool is pulled out of the wellbore.

Embodiment 8. The method of embodiment 1, wherein the controller is located remote from a rig that is performing a subterranean operation.

Embodiment 9. The method of embodiment 1, determining, via the controller, the gravity toolface azimuth of the logging tool based on an equation:

$$\varphi(t) = \gamma + \int_{t_0}^{\tau} \frac{gyro(\tau) - \beta}{\alpha} d\tau$$

where $\varphi(\tau)$ is the gravity toolface azimuth as a function of time; $\alpha$, $\beta$, and $\gamma$ are coefficients; and $gyro(\tau)$ is the angular gyroscope sensor data as a function of time.

Embodiment 10. The method of embodiment 9, further comprising collecting imagery from one or more imaging sensors in a bottom hole assembly (BHA), wherein the BHA rotates with the logging tool; and correlating the gravity toolface azimuth with the imagery to produce a modified image.

Embodiment 11. The method of embodiment 10, wherein the modified image is displayed on an operator's display or stored for later review by a user.

Embodiment 12. The method of embodiment 10, wherein correlating the gravity toolface azimuth with the imagery comprises synchronizing timing data for the gravity toolface azimuth with timing data for the imagery.

Embodiment 13. The method of embodiment 9, determining, via the controller, the $\alpha$, $\beta$, $\gamma$ coefficients by minimizing an equation:

$$\frac{1}{\Delta T} \int_{t_0}^{t_0+\Delta T} \left| accel_r(t) - \hat{g} \cdot \cos\left(\gamma + \int_{t_0}^{\tau} \frac{gyro(\tau) - \beta}{\alpha} d\tau\right) - a_r^0 - r\left(\frac{gyro(t) - \beta}{\alpha}\right)^2 \right|^2 dt \xrightarrow{\alpha,\beta,\gamma} \min$$

where $accel_r(\tau)$ is the radial acceleration component.

Embodiment 14. The method of any one of embodiments 1 to 13, further comprising rotating the logging tool within a cased portion of a wellbore; and determining the gravity toolface azimuth based on the accelerometer sensor data and the angular gyroscope sensor data that are collected by the accelerometer sensor and the angular gyroscope sensor and stored in the logging tool while the logging tool is positioned within the cased portion.

Embodiment 15. The method of embodiment 14, wherein the gravity toolface azimuth is determined by a controller at the surface.

Embodiment 16. The method of embodiment 14, wherein the gravity toolface azimuth is determined by a controller that is positioned downhole.

Embodiment 17. The method of embodiment 1, wherein the accelerometer sensor is positioned on an X-axis of the logging tool, wherein the X-axis is perpendicular to the center axis, and wherein the radial acceleration component equals an X-axis acceleration component of the accelerometer sensor.

Embodiment 18. The method of embodiment 17, wherein the accelerometer sensor is positioned a distance r from the center axis along the X-axis.

Embodiment 19. The method of embodiment 1, wherein the accelerometer sensor is positioned away from an X-axis, and wherein the radial acceleration component is determined based on an X-axis acceleration component and a Y-axis acceleration component of the accelerometer sensor.

Embodiment 20. The method of embodiment 19, wherein the radial acceleration component is determined based on an equation:

$$a_x \cos(\theta) - a_y \sin(\theta) = accel_r$$

where $\theta$ is an angle of rotation about the center axis from the X-axis to the accelerometer sensor, $a_x$ is the X-axis acceleration component of the accelerometer sensor, $a_y$ is the Y-axis acceleration component of the accelerometer sensor, and $accel_r$ is the radial acceleration component.

Embodiment 21. The method of embodiment 1, wherein the accelerometer sensor and the angular gyroscope sensor are positioned on a printed circuit board (PCB) within a body of the logging tool.

Embodiment 22. The method of embodiment 21, wherein the accelerometer sensor is positioned at an X-axis of the logging tool and on the PCB, with the PCB being perpendicular to the X-axis, and wherein the angular gyroscope sensor is spaced away from the accelerometer sensor.

Embodiment 23. The method of embodiment 21, wherein the accelerometer sensor is positioned one the PCB at an X-axis with the PCB being parallel to the X-axis, and wherein the angular gyroscope sensor is spaced away from the accelerometer sensor along the X-axis.

Embodiment 24. The method of embodiment 21, wherein the accelerometer sensor is positioned on the PCB and spaced away from an X-axis with the PCB being perpendicular to the X-axis, and wherein the angular gyroscope sensor is spaced away from the accelerometer sensor.

Embodiment 25. A system configured to carry out any of the methods claimed herein.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A method for determining gravity toolface azimuth, the method comprising:

rotating a logging tool about a center axis in a wellbore;

positioning an accelerometer sensor within the logging tool at a first radial distance from the center axis, wherein the accelerometer sensor is positioned along a radial line extending from the center axis to a gravity toolface of the logging tool;

positioning an angular gyroscope sensor within the logging tool at a second radial distance from the center axis;

receiving, at a controller, accelerometer sensor data from a single axis sensor of the accelerometer sensor and angular gyroscope sensor data from the angular gyroscope sensor, wherein the accelerometer sensor data and the angular gyroscope sensor data are measured during each time segment of a plurality of time segments as the logging tool rotates;

determining, via the controller and based on the accelerometer sensor data from only the single axis sensor, a radial acceleration component for each of the plurality of time segments of the accelerometer sensor data from the single axis sensor for each respective time segment of the plurality of time segments;

determining, via the controller, a gain and an offset of the angular gyroscope sensor based on the radial acceleration component for each of the respective time segments; and determining, via the controller, the gravity toolface azimuth of the logging tool as a function of time based on the gain, the offset, and the angular gyroscope sensor data for each of the respective time segments.

2. The method of claim 1, wherein the controller is located at or near a rig that is performing a subterranean operation.

3. The method of claim 2, wherein the subterranean operation is drilling the wellbore.

4. The method of claim 3, wherein the logging tool stores the accelerometer sensor data and the angular gyroscope sensor data in the logging tool for later retrieval at the surface when the logging tool is pulled out of the wellbore.

5. The method of claim 4, wherein the accelerometer sensor data and the angular gyroscope sensor data are retrieved from the logging tool by rig equipment on a rig and transferred by rig equipment to a database for future processing or to the controller for real-time processing.

6. The method of claim 1, wherein the controller is located downhole with the logging tool in the wellbore.

7. The method of claim 6, wherein the controller determines the gravity toolface azimuth as a function of time and stores the gravity toolface azimuth in the logging tool downhole for later retrieval at the surface when the logging tool is pulled out of the wellbore.

8. The method of claim 1, further comprising rotating the logging tool within a cased portion of the wellbore; and determining the gravity toolface azimuth based on the accelerometer sensor data and the angular gyroscope sensor data that are collected by the accelerometer sensor and the angular gyroscope sensor and stored in the logging tool while the logging tool is positioned within the cased portion.

9. The method of claim 8, wherein the gravity toolface azimuth is determined by the controller which is positioned at the surface.

10. The method of claim 8, wherein the gravity toolface azimuth is determined by the controller which is positioned downhole.

11. The method of claim 1, wherein the accelerometer sensor is positioned on an X-axis of the logging tool, wherein the X-axis is perpendicular to the center axis, and wherein the radial acceleration component equals an X-axis acceleration component of the accelerometer sensor.

12. The method of claim 11, wherein the accelerometer sensor is positioned a distance r from the center axis along the X-axis.

13. The method of claim 1, wherein the accelerometer sensor is positioned away from an X-axis, and wherein the radial acceleration component is determined based on an X-axis acceleration component and a Y-axis acceleration component of the accelerometer sensor.

14. The method of claim 1, wherein the accelerometer sensor and the angular gyroscope sensor are positioned on a printed circuit board (PCB) within a body of the logging tool.

15. The method of claim 14, wherein the accelerometer sensor is positioned at an X-axis of the logging tool and on the PCB, with the PCB being perpendicular to the X-axis, and the angular gyroscope sensor is spaced away from the accelerometer sensor; or the accelerometer sensor is positioned on the PCB at an X-axis with the PCB being parallel to the X-axis, and the angular gyroscope sensor is spaced away from the accelerometer sensor along the X-axis.

16. A method for determining gravity toolface azimuth, the method comprising:

rotating a logging tool about a center axis, wherein the logging tool comprises an accelerometer sensor at a first radial distance from the center axis and an angular gyroscope sensor at a second radial distance from the center axis;

receiving, at a controller, accelerometer sensor data from the accelerometer sensor and angular gyroscope sensor data from the angular gyroscope sensor as the logging tool rotates;

determining, via the controller, a radial acceleration component of the accelerometer sensor from the accelerometer sensor data;

determining, via the controller, a gain and an offset of the angular gyroscope sensor based on the radial acceleration component; and determining, via the controller, the gravity toolface azimuth of the logging tool as a function of time based on the gain, the offset, and the angular gyroscope sensor data; and determining, via the controller, the gravity toolface azimuth of the logging tool based on an equation:

$$\varphi(t) = \gamma + \int_{t_0}^{t} \frac{gyro(\tau) - \beta}{\alpha} d\tau$$

where φ(t) is the gravity toolface azimuth as a function of time; α, β, and γ are coefficients; and gyro(τ) is the angular gyroscope sensor data as a function of time.

17. The method of claim 16, further comprising collecting imagery from one or more imaging sensors in a bottom hole assembly (BHA), wherein the BHA rotates with the logging tool; and correlating the gravity toolface azimuth with the imagery to produce a modified image.

18. The method of claim 17, wherein correlating the gravity toolface azimuth with the imagery comprises synchronizing timing data for the gravity toolface azimuth with timing data for the imagery.

19. The method of claim 16, determining, via the controller, the α, β, γ coefficients by minimizing an equation:

$$\square(1/\Delta T)\int_(t_0)^{\wedge}(t_0+\Delta T)\ \left|[\![accel]\!]_r(t) - g^{\wedge}\cdot\cos\left(\gamma + \int_(t_0)^{\wedge}t\ (gyro(\tau)-\beta)/\alpha\ d\tau\right) - a_r^{\wedge}0 - r\left((gyro(t)-\beta)/\alpha\right)^{\wedge}2\right|^{\wedge}2\ dt\square(\rightarrow\ \perp(\alpha,\beta,\gamma))\min$$

where $accel_r(t)$ is the radial acceleration component.

20. A method for determining gravity toolface azimuth, the method comprising:

rotating a logging tool about a center axis, wherein the logging tool comprises an accelerometer sensor at a first radial distance from the center axis and an angular gyroscope sensor at a second radial distance from the center axis;

receiving, at a controller, accelerometer sensor data from the accelerometer sensor and angular gyroscope sensor data from the angular gyroscope sensor as the logging tool rotates;

determining, via the controller, a radial acceleration component of the accelerometer sensor from the accelerometer sensor data;

determining, via the controller, a gain and an offset of the angular gyroscope sensor based on the radial acceleration component; and determining, via the controller, the gravity toolface azimuth of the logging tool as a function of time based on the gain, the offset, and the angular gyroscope sensor data, wherein the accelerometer sensor is positioned away from an X-axis, and wherein the radial acceleration component is determined based on an X-axis acceleration component and a Y-axis acceleration component of the accelerometer sensor, wherein the radial acceleration component is determined based on an equation:

$$a_x \cos(\theta) - a_y \sin(\theta) = accel_r$$

where θ is an angle of rotation about the center axis from the X-axis to the accelerometer sensor, $a_x$ is the X-axis acceleration component of the accelerometer sensor, $a_y$ is the Y-axis acceleration component of the accelerometer sensor, and $accel_r$ is the radial acceleration component.

* * * * *